US006878306B2

(12) United States Patent
Gao

(10) Patent No.: US 6,878,306 B2
(45) Date of Patent: Apr. 12, 2005

(54) MAGNETIC WRITING SCREEN DISPERSION MEDIUM

(75) Inventor: Tao Shi Gao, Cheng Du (CN)

(73) Assignee: Tsuen Lee Metals & Plastic Toys Co., Ltd., Kowloon (HK)

( * ) Notice: Subject to any disclaimer, the term of this patent is extended or adjusted under 35 U.S.C. 154(b) by 110 days.

(21) Appl. No.: 09/935,721

(22) Filed: Aug. 24, 2001

(65) Prior Publication Data

US 2002/0166991 A1 Nov. 14, 2002

Related U.S. Application Data

(60) Provisional application No. 60/289,798, filed on May 10, 2001.

(51) Int. Cl.[7] ..... B43L 1/00

(52) U.S. Cl. ..... 252/62.52; 252/62.53; 252/62.54; 252/62.55; 252/62.51 R; 434/409

(58) Field of Search ..... 434/409; 252/62.52, 252/62.53, 62.54, 62.55, 62.51 R

(56) References Cited

U.S. PATENT DOCUMENTS

| | | | | | |
|---|---|---|---|---|---|
| 4,143,472 | A | * | 3/1979 | Murata et al. | 434/409 |
| 4,536,428 | A | | 8/1985 | Murata et al. | 434/409 |
| 4,643,684 | A | | 2/1987 | Murata et al. | 434/409 |
| 5,151,032 | A | | 9/1992 | Igawa | 434/409 |
| 5,411,398 | A | | 5/1995 | Nakanishi et al. | 434/409 |
| 5,429,503 | A | | 7/1995 | Murata et al. | 434/409 |
| 5,788,506 | A | * | 8/1998 | Chabay | 434/301 |
| 5,846,630 | A | | 12/1998 | Tazaki et al. | 428/68 |
| 6,007,734 | A | | 12/1999 | Tazaki et al. | 252/62.54 |
| 6,103,347 | A | | 8/2000 | Nojima et al. | 428/174 |
| 6,419,498 | B1 | * | 7/2002 | Ikeda et al. | 434/409 |

FOREIGN PATENT DOCUMENTS

| | | | |
|---|---|---|---|
| JP | 2000-122577 | * | 4/2000 |

* cited by examiner

*Primary Examiner*—C. Melissa Koslow
(74) *Attorney, Agent, or Firm*—Hoffman, Wasson & Gitler, P.C.

(57) ABSTRACT

A magnetic dispersion medium is used in a magnetic writing screen toy. The dispersion medium is attracted to the underside of the screen when a magnetic tipped pen is passed over the upper surface of the screen. A user can create drawings and figures. The dispersion medium is non-toxic, creates lines having good contrast and can be easily erased without permanently forming black marks on the screen. The dispersion medium works well in temperature ranges between −20° C. to 45° C.

12 Claims, No Drawings

MAGNETIC WRITING SCREEN DISPERSION MEDIUM

This application claims the benefit of U.S. provisional patent application Ser. No. 60/289,798, filed May 10, 2001.

BACKGROUND OF THE INVENTION

Magnetic writing screens are popular toys with young children. These toys consist of a screen in a housing containing a dispersion medium. The dispersion medium contains magnetic material such as iron powder. A pen having a magnetic tip is drawn across the screen causing the dispersion medium to be drawn up against the underside of the screen. By tracing the pen across the screen, the user can create drawings and figures. A sliding mechanism is usually employed to remove the dispersion medium from the underside of the screen to erase the drawings and begin anew.

The dispersion medium must be able to be attracted by the relatively weak magnet of the pen. Also, the dispersion medium must create good contrast and clear drawing lines. The dispersion medium must adequately cling to the underside of the screen but be easily removed under the action of a device such as a sliding mechanism. The complete removal of the dispersion medium from the underside of the screen is necessary to insure the long lasting use of the toy.

The prior art discloses several types of dispersion mediums used in magnetic writing screen toys. Problems with the prior art include the toxicity of the dispersion medium. Because it is possible that a child can break the housing, the dispersion medium can leak from the toy. For this reason, it is very important that the substance be non-toxic. Also, some dispersion mediums have poor contrast between black and white. The result is that the drawn line is blurred and broken. Some dispersion mediums have been developed which have very good contrast when drawn on a screen. However, these dispersion mediums are hard to erase from the screen. Eventually, permanent black spots appear on the screen after the toy has been used multiple times. Once this occurs, drawings made in the future are not as clear.

It is an object of the invention to provide a magnetic dispersion medium that is non-toxic.

It is another object of the invention to provide a magnetic dispersion medium that provides good contrast when lines are drawn on the magnetic screen.

It is yet another object of the invention to provide a liquid dispersion medium that is easily erased from the screen.

It is yet another object of the invention to provide a dispersion medium that can be used to drawn lines on the screen hundreds of times without creating permanent black marks on the screen.

These and other objects of the invention will become apparent after reading the disclosure of the invention.

SUMMARY OF THE INVENTION

A magnetic dispersion medium is used in a magnetic writing screen toy. The dispersion medium is attracted to the underside of the screen when a magnetic tipped pen is passed over the upper surface of the screen. A user can create drawings and figures. The dispersion medium is non-toxic, creates lines having good contrast and can be easily erased without permanently forming black marks on the screen. The dispersion medium works well in temperature ranges between −20° C. to 45° C.

The magnetic dispersion material is formed by a bulk material, a first and second colorant, a thickener and a magnetic material. In a preferred embodiment, the bulk material is liquid paraffin, the thickener is silica, and the magnetic material is iron powder. The colorants are titanium dioxide and benzo oxazole fluorescent whitener.

DETAILED DESCRIPTION OF THE INVENTION

The bulk of the liquid dispersion medium is liquid paraffin, commonly known as "white oil", that is a mixture of alkanes and cycloparaffins. Silica ($SiO_2$) is added as a thickener and titanium dioxide ($TiO_2$) is added as a colorant. Both of these ingredients are present in 1.5% to 3% by weight. A second colorant, benzo oxazole fluorescent whitener, commonly sold under the trade name Uvitex OB. Uvitex OB is added in the amount of 0.005% to 0.0010% by weight. Iron powder accounts for 13% to 20% by weight of the mixture. The iron powder is made by grinding electrical iron steel sheets containing up to 17% manganese and selecting iron particles less than 100 microns in diameter. No other special processing is done to the iron powder. Of course, the iron powder is what is attracted by the magnetic tipped pen and the balance of the magnetic dispersion medium imparts the desirable characteristics to one another. The dispersion liquid medium is encased within polyvinylchloride honeycomb cellular structure sandwiched between two transparent top sheets of polyvinylchloride and a bottom opaque sheet of polyvinylchloride. An adhesive is used to bond the honeycomb cells to the top and bottom sheets to form a hermetically sealed housing. The magnetic dispersion medium fills the honeycomb cells and is sealed within them. The adhesive used to bond the honeycomb cells to the top and bottom sheets consists of cyclohexanone and polyvinylchloride. The cyclohexanone evaporates during use.

Once the housing is formed, it is suitable for use. During use, a magnetic tipped pen attracts the iron powder to the top sheet leaving a line of black iron particles visible in the white dispersion medium. The thick dispersion medium prevents the iron particles from moving or settling due to gravity. In this way, the user is able to form lines having good contrast in order to create figures or drawings. The iron particles will remain on the underside of the top sheets until removed. For removal, a magnetic strip is moved across the underside of the bottom sheet to pull the iron particles away from the top sheet, therefore erasing the lines. This process can be repeated hundreds of times without the iron powder permanently adhering to the underside of the top sheets.

A preferred embodiment of the invention has been described; however, several variations and modifications would be apparent to one of ordinary skill in the art. The disclosure is not intended to be limited in any way, but the invention is defined by the appended claims.

What is claimed is:

1. A magnetic dispersion medium, comprising:

a bulk material, a first colorant, wherein said first colorant is titanium dioxide, a second colorant, wherein said second colorant is benzo oxazole fluorescent whitener, a thickener, and a magnetic material.

2. The magnetic dispersion material of claim 1, wherein said bulk material is liquid paraffin.

3. The magnetic dispersion material of claim 1, wherein said thickener is silica.

4. The magnetic dispersion material of claim 1, wherein said magnetic material is iron powder.

5. The magnetic dispersion material of claim 4, wherein said iron powder contains up to 17 percent manganese.

6. The magnetic dispersion material of claim 4, wherein said iron powder has particles less than 100 microns in diameter.

7. A magnetic dispersion medium comprising:

a bulk material, a colorant, said colorant being benzo oxazole fluorescent whitener, a thickener, and a magnetic material.

8. The magnetic dispersion medium of claim 7, wherein said bulk material is liquid paraffin, said thickener is silica, and said magnetic material is iron powder.

9. A magnetic dispersion medium, comprising:

liquid paraffin as a bulk material, silica for thickening, benzo oxazole fluorescent whitener, as a first colorant, titanium dioxide as a second colorant, and iron powder.

10. The magnetic dispersion material of claim 9, wherein said benzo oxazole fluorescent whitener is 0.005% by weight.

11. The magnetic material of claim 9, wherein said titanium dioxide is present in the amount of 1.5% to 3% by weight.

12. The magnetic material of claim 9, wherein said silica is present in the amount of 1.5% to 3% by weight.

* * * * *